United States Patent [19]

Bayha et al.

[11] Patent Number: 4,516,131

[45] Date of Patent: May 7, 1985

[54] VARIABLE SLOT CONDUCTANCE DIELECTRIC ANTENNA AND METHOD

[75] Inventors: William T. Bayha; John Borowick, both of Bricktown; Richard A. Stern, Allenwood; Richard W. Babbitt, Fair Haven, all of N.J.

[73] Assignee: The United States of America represented by the Secretary of the Army, Washington, D.C.

[21] Appl. No.: 463,799

[22] Filed: Feb. 4, 1983

[51] Int. Cl.[3] ..... H01Q 13/28

[52] U.S. Cl. ..... 343/785; 343/770

[58] Field of Search ..... 343/785, 770, 771, 700 MS

[56] References Cited

FOREIGN PATENT DOCUMENTS 1194342 6/1970 United Kingdom ..... 343/785

2097196 10/1982 United Kingdom ..... 343/785

OTHER PUBLICATIONS

Song et al.; Leaky-Wave Antenna; 1979 IEEE MTT-S Int. Microwave Symp. Dig.; Orlando, Fla.; Apr. 30-May 2, 1979, pp. 217-219.

*Primary Examiner*—Eli Lieberman

*Attorney, Agent, or Firm*—Anthony T. Lane; Jeremiah G. Murray; Edward Goldberg

[57] ABSTRACT

A variable slot conductance dielectric wavequide antenna in which the transmission line and radiating aperture is formed in one continuous, integrated and homogeneous material. The radiated antenna beam pattern is controlled by varying the conductance of radiating slots using varied geometries for each of the slots.

9 Claims, 4 Drawing Figures

VARIABLE SLOT CONDUCTANCE DIELECTRIC ANTENNA AND METHOD

STATEMENT OF GOVERNMENT INTEREST

The invention described herein may be manufactured, used, and licensed by or for the Government for Governmental purposes without the payment to me of any royalties thereon.

BACKGROUND OF THE INVENTION

This invention relates generally to millimeter wavelength, frequency scannable dielectric antennas, and more particularly, to controlled aperture illumination of such antennas.

Antenna beam scanning can be accomplished by several methods depending on the requirements of a particular application. In the case of microwave frequency applications, the simplest expedient is often found to be that of mechanically scanning the antenna by physically moving the entire antenna structure. For system applications where fast and precise beam steering is required, inertialess beam scanning is used. Inertialess beam scanning is generally accomplished electronically by altering the phase of a traveling wave across the radiating aperture of a waveguide using discrete phase-shifting components or by altering the frequency whereby an inherent phase shift is attained between individual radiating elements.

For millimeter wave frequencies, that is, the 30 to 300 GHz range, mechanical scanning is used in virtually all system applications. This is a result of the fact that inertialess scanning at millimeter wavelengths has been difficult to achieve because of the impracticality in size of the components that would be needed for beam steering.

Recent advancements in the field of millimeter wave antennas have resulted in the development of an inertialess scanning device in the form of the dielectric waveguide line source antenna as disclosed in U.S. Patent Application Ser. No. 409,201, now issued as U.S. Pat. No. 4,468,673. This type of antenna is a travelling wave type of structure and is unique in that the transmission line and the antenna aperture are an integral, homogeneous structure having radiation characteristics derived by way of the introduction of a number of identical slots cut into one wall of the transmission line. For the case in which all of the radiating slots are identical, the antenna displays a radiation pattern characterized by high, close-in sidelobes on the order of 12 to 13 dB. Sidelobes of this order are often found to be unacceptable for high performance radar and communications systems.

In order to reduce these high sidelobes, a symmetrically tapered amplitude distribution is required That is, a greater amount of energy should be radiated from the center of the array of radiating elements as compared to those elements at the ends. This type of distribution may be achieved by varying the conductance of the radiating elements along the length of the array.

In the case of a metallized antenna structure, the thickness of the metallized radiating elements along the array can be varied in order to produce the desired tapered amplitude excitation. This approach to the problem, however, offers no solution in the case of a dielectric antenna system.

SUMMARY OF THE INVENTION

The object of the invention is to provide the capability of synthesizing desired radiation patterns for dielectric antennas without the need for any metallization on the radiating surface.

The frequency scanned dielectric antenna according to the present invention provides for sidelobe control by varying the slot conductance along the length of the antenna through the process of varying the slot width or slot depth, or both. By varying the slot conductance, and hence the amount of energy that each slot contributes to the beam pattern in the far field, lower sidelobe levels are achieved.

DESCRIPTION OF THE PREFERRED EMBODIMENT

Figure 1:
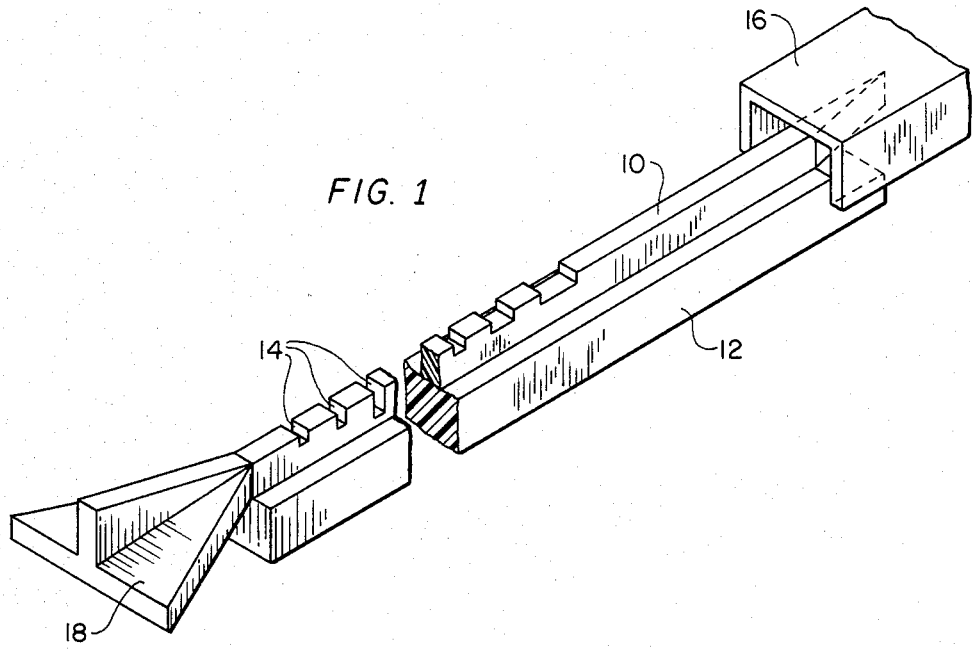
FIG. 1 is a schematic representation of a variable slot conductance dielectric antenna constructed in accordance with the invention.

Referring to FIG. 1, an antenna constructed in accordance with the invention is shown having dielectric waveguide 10 mounted on support 12. The dielectric waveguide 10 has a high dielectric constant (e.g., $\epsilon=16$) while support 12 may be either a low dielectric (e.g., $\epsilon=2$ to 4) supporting substrate for an insular guide or metal for an image guide. A traveling wave of millimeter wavelength is propagated in dielectric waveguide 10 from metal waveguide 16 while absorber 18 acts to prevent reflection back into waveguide 10 of any wave energy which is not radiated. Periodic slots 14 cut into the top wall of waveguide 10 act as perturbations to the RF field propagating down the length of the slotted array causing waveguide 10 to function as an antenna. Thus, the entire antenna is on one substrate, including the transmission line and radiating aperture in one continuous, integrated, homogeneous material.

Figure 2:
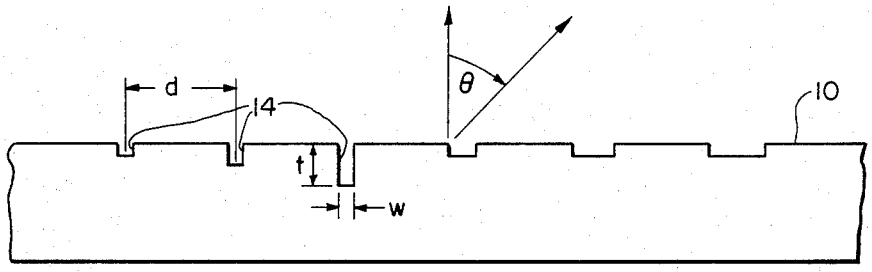
FIG. 2 is a detailed view showing the slot structure of a dielectric waveguide.

In FIG. 2, a detail view of dielectric waveguide 10 is shown to have slots 14 of varying geometries periodically spaced by interval d. Each of the slots 14 is characterized by a width w and depth t. A main beam is radiated from the waveguide 10 in a direction determined by the relative phase change between each of the successive radiating slots 14. By changing the frequency, there will be a change in the relative phase between adjacent slots 14, thus changing the direction of the main beam. The direction of the main beam, shown in FIG. 2 as measured by the angle $\theta$ is, for a particular frequency given by:

$$\sin\theta=\lambda o/\lambda g-\lambda o/d$$

where $\lambda o$ is the wavelength in free space and $\lambda g$ is the wavelength in the dielectric waveguide 10 at the operating frequency. It is noted that the formula for the main beam angle is derived solely on the basis of the periodicity of the slots 14 and is independent of their detailed geometries.

Figure 3:
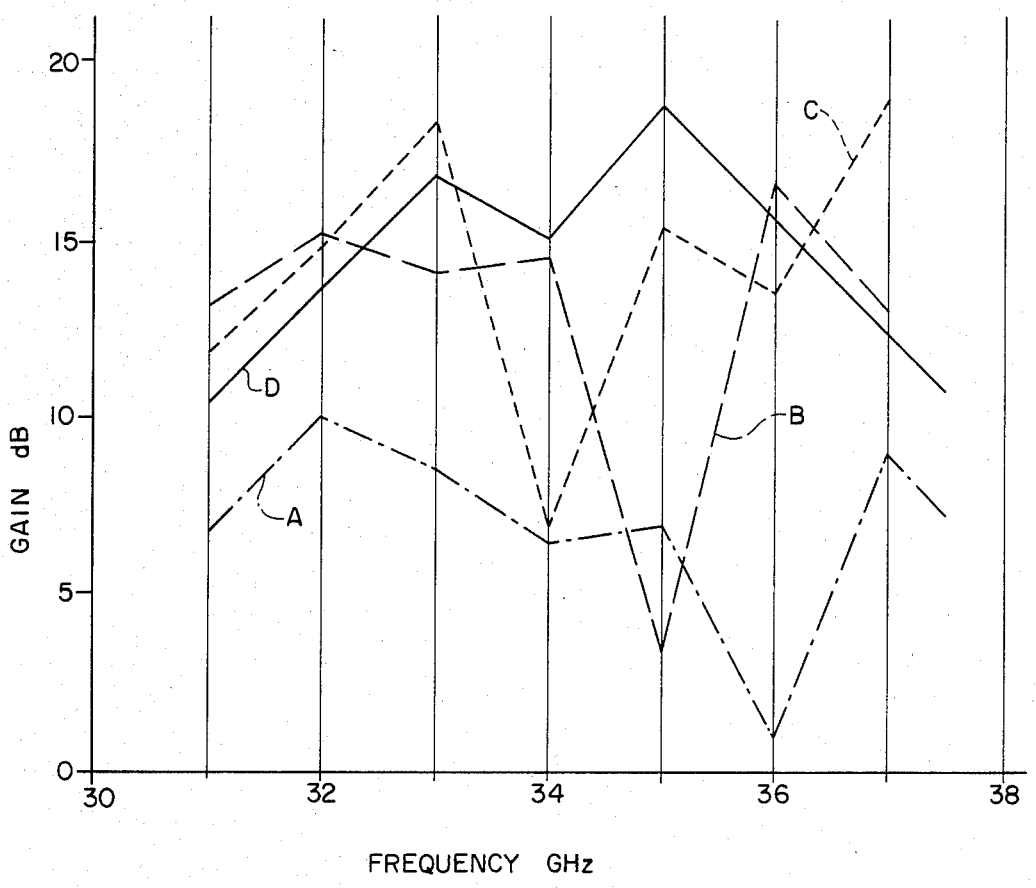
FIG. 3 is a graph showing gain vs. frequency for four antennas of varying slot geometries.

FIG. 3 shows the far field power gain for four dielectric waveguide antennas in accordance with the invention, each of the antennas being of identical construction except for the slot geometries which are as indicated in the following table. For each of the patterns shown, the slot spacing, d, is 0.139 inches.

| | w (in.) | t (in.) |
|---|---|---|
| A | 0.010 | 0.010 |
| B | 0.010 | 0.014 |
| C | 0.010 | 0.018 |
| D | 0.005 | 0.014 |

It is observed that for a given operating frequency, there is a direct relationship between power gain and slot geometry. For the case in which all of the slots are uniform, each of the slots couples out an amount of energy which is proportional to its incident energy. Thus, a uniform slotted array results in an illumination along the antenna which is exponentially decaying. However, by combining the various slot dimensions to form a composite antenna structure, lower sidelobe pattern may be generated.

Figure 4:
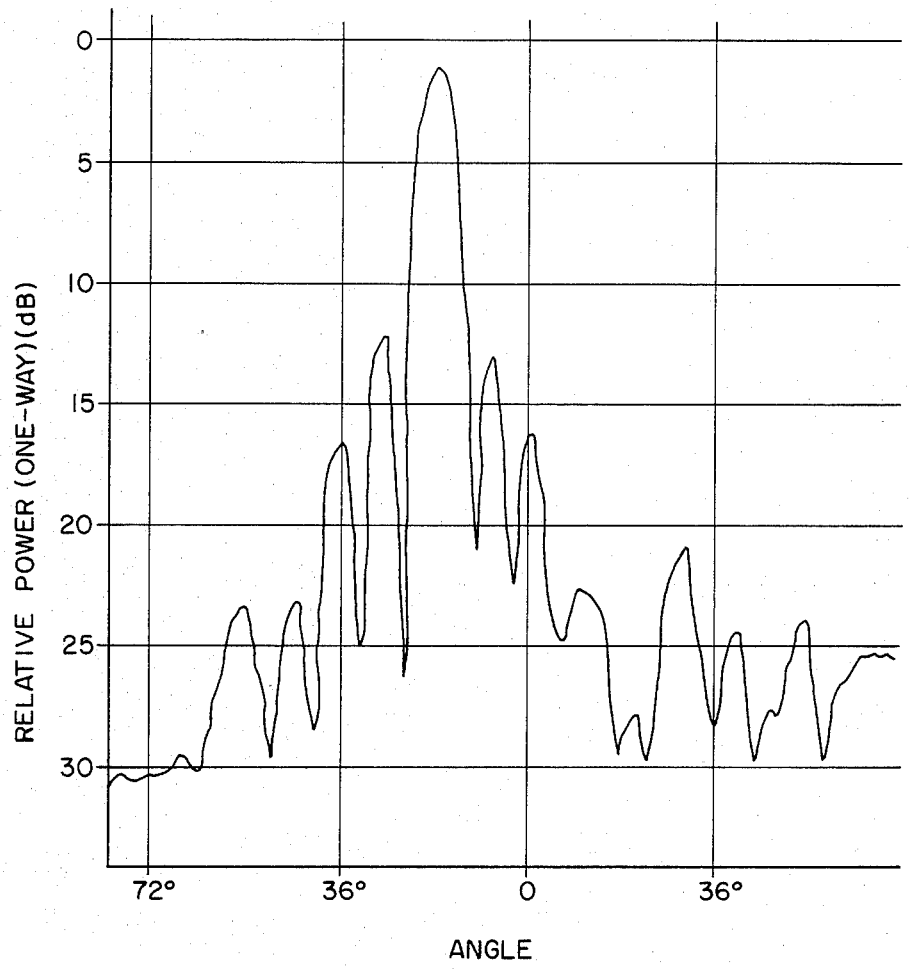
FIG. 4 shows the radiation pattern of a beam.

A typical far field E-plane pattern for a uniform slotted array is shown in FIG. 4. In this case, the sidelobes are asymmetric and are typically 12 dB down. By controlling the slot conductance, and hence the power coupled out by each slot, a beam pattern with low sidelobes may be achieved by designing for a tapered amplitude distribution of output energy along the waveguide.

By way of illustration of this technique, the slot conductance could be varied in such a way as to compensate for the loss in incident energy at one slot due to energy radiated from the previous slot and thereby produce a uniform illumination. This pattern has been shown to have symmetric sidelobes that are 13 dB down from the main beam.

More complicated patterns with lower sidelobes are readily achieved by well-known techniques of pattern synthesis. Other embodiments of the invention could consist of all slots having the same width but of varying depths, or alternatively, all slots could have the same depth with varying widths. A typical embodiment, however, would utilize both types of slots as the depth is limited by the height of the antenna and the width is limited by slot separation.

It should be understood, of course, that the foregoing disclosure relates to only a preferred embodiment of the invention and that numerous modifications or alterations may be made therein without departing from the spirit and the scope of the invention as set forth in the appended claims.

What is claimed is:

1. A variable slot conductance dielectric antenna comprising:

a section of dielectric waveguide having input and output ends; and a plurality of periodic radiating slots formed in the surface of said waveguide as an array along the length of said waveguide, said slots having a predetermined uniform periodic spacing along said length, each slot having a predetermined width and depth dimension, said width and depth dimensions being selectively non-uniform to control the conductance of each of said slots and the radiation pattern along the length of said waveguide.

2. An antenna according to claim 1 wherein said radiating slots are of uniform depth.

3. An antenna according to claim 1 wherein said radiating slots are of uniform width.

4. A frequency scanned dielectric antenna comprising:

a section of dielectric waveguide having a rectangular cross-section;

a plurality of uniformly spaced periodic radiating slots formed in the upper surface of said waveguide, each slot having predetermined width and length dimensions;

said width and depth dimensions being selectively non-uniform to control the conductance of each of said slots and the radiation pattern along the length of said waveguide;

a support means affixed to the lower surface of said waveguide;

means for applying millimeter wavelength traveling waves of varying frequency to one end of said waveguide; and absorber means affixed to the other end of said waveguide.

5. An antenna according to claim 4 wherein said radiating slots are of uniform depth.

6. An antenna according to claim 4 wherein said radiating slots are of uniform width.

7. An antenna according to claim 4 wherein said dielectric waveguide has a high dielectric constant.

8. An antenna according to claim 4 wherein said support means is a dielectric substrate having a low dielectric constant.

9. An antenna according to claim 4 wherein said support means is a metal substrate.

* * * * *